US008549822B2

(12) United States Patent
Lerner et al.

(10) Patent No.: US 8,549,822 B2
(45) Date of Patent: Oct. 8, 2013

(54) PACKAGING MACHINE AND PROCESS

(75) Inventors: Hershey Lerner, Aurora, OH (US); Joseph Lattur, Stow, OH (US)

(73) Assignee: Automated Packaging Systems, Inc., Streetsboro, OH (US)

( * ) Notice: Subject to any disclaimer, the term of this patent is extended or adjusted under 35 U.S.C. 154(b) by 293 days.

(21) Appl. No.: 11/487,681

(22) Filed: Jul. 17, 2006

(65) Prior Publication Data

US 2008/0010944 A1 Jan. 17, 2008

(51) Int. Cl.
*B65B 1/24* (2006.01)
*B65B 63/02* (2006.01)

(52) U.S. Cl.
USPC ..... 53/436; 53/526

(58) Field of Classification Search
USPC ..... 53/455, 481, 373.6, 562, 526, 528, 53/436
See application file for complete search history.

(56) References Cited

U.S. PATENT DOCUMENTS 2,907,447 A * 10/1959 Offutt et al. ..... 198/579
3,254,828 A 6/1966 Lerner
3,688,463 A * 9/1972 Titchenal ..... 53/434
3,886,713 A * 6/1975 Mitchell et al. ..... 53/436
4,344,557 A 8/1982 Lerner
4,858,416 A * 8/1989 Monaghan ..... 53/439
5,722,218 A 3/1998 Lerner
5,743,070 A 4/1998 Lerner et al.
5,887,412 A * 3/1999 Lerner et al. ..... 53/481
5,957,824 A 9/1999 Lerner et al.
5,996,319 A * 12/1999 Lerner et al. ..... 53/481
6,170,238 B1 1/2001 Lerner
6,367,975 B1 4/2002 Cronauer et al.
6,889,739 B2 * 5/2005 Lerner et al. ..... 156/498
2005/0132672 A1 6/2005 Lerner et al.
2006/0096254 A1 * 5/2006 Rogers ..... 53/469

* cited by examiner

*Primary Examiner* — M. Alexandra Elve
*Assistant Examiner* — John Paradiso
(74) *Attorney, Agent, or Firm* — Calfee, Halter & Griswold LLP

(57) ABSTRACT

In one embodiment, a packaging machine includes a mechanism for compressing one or more sides of the bag to expel excess air from an open top end of the bag. In one embodiment, a packaging machine supports a top portion of a bag and a bottom portion of the bag, such that the bottom portion of the bag is moved closer to the top portion of the bag as the bag is moved from a first location to a second location. The bags may be supported from below such that additional support is provided during compression of the bag to remove excess air.

18 Claims, 16 Drawing Sheets

38
48
40
49
41
39

48
38
40S
51
46
40
49
41
39
41S
52

17
66
60
32
28
61
35
45
40
48
46
49
58
36
24
23
27
30
25
15
55
54
58
53
31
33
6
7
41
62
96
90
92

PACKAGING MACHINE AND PROCESS

TECHNICAL FIELD

This invention relates to packaging and more particularly to a packaging machine that forms packages using preformed side connected bags.

BACKGROUND OF THE INVENTION

U.S. Pat. No. 5,743,070 (herein the S P Patent) entitled PACKAGING MACHINE, MATERIAL AND METHOD discloses a machine for use in packaging which has been highly successful commercially. The S P Patent and patents which resulted from divisional applications claim a machine and a plastic web used by that machine as well as a process of making packages.

With the machine of the S P Patent the web is fed first through a slitter which splits a top portion into two lips that are respectively grasped between associated pairs of belts for transport through a load section. The belts which transport the web through the load section are more fully described in U.S. Pat. No. 5,722,218 issued Mar. 3, 1998 and entitled PLASTIC TRANSPORT SYSTEM (herein the Load Belt Patent).

As the web is fed to the load section, the lips are spread to effect the sequential opening of the side connected bags, each into a rectangular opening for receiving a product to be packaged. The lips are then returned to juxtaposed relationship and trimmed as the lips are grasped by further belts in a sealer section. The further belts are preferably belts of the type described and claimed in U.S. Pat. No. 6,170,238 issued Jan. 9, 2001 and entitled SEALING MACHINE AND METHOD (herein the Sealer Belt Patent).

The S P, Load Belt and Sealer Belt Patents are incorporated herein by reference in their entireties.

SUMMARY OF DISCLOSURE

The present application relates to the removal of excess air from a packaging bag prior to sealing. A packaging machine that removes excess air may include a mechanism for compressing one or more sides of the bag to expel excess air from an open top end of the bag. In addition, the packaging machine may support the bags from below. For example, the machine may include a support surface that provides support during compression of the bag to remove excess air.

One type of packaging machine forms packages from a chain of side connected bags. The machine may include a support surface that is positioned to support the chain of bags from below as the chain of bags is moved along the path of travel. The machine may include a bag compressing arrangement that compresses sides of the bag to remove excess air from the bag prior to sealing the open end of the bag. The support surface may bring at least a bottom portion of the bag toward the compressing arrangement to facilitate removal of the excess air.

A method of forming packages from a chain of side connected bags each having an open top end portion and a closed bottom end portion and sidewalls therebetween is disclosed in this application. In the method, the top end portion of at least one bag is held open. The at least one bag is positioned at a first location where the closed bottom portion is supported at a first distance from the open end. An item is deposited into the at least one bag through the open top end at the first location. The at least one bag is transported to a second location where the bottom end portion is supported at a second distance from the open end that is shorter than the first distance. The side walls of the at least one bag are compressed at the second location. The open top end of the at least one compressed bag is sealed to form a package.

DETAILED DESCRIPTION

I. The Overall Machine

Figure 1:
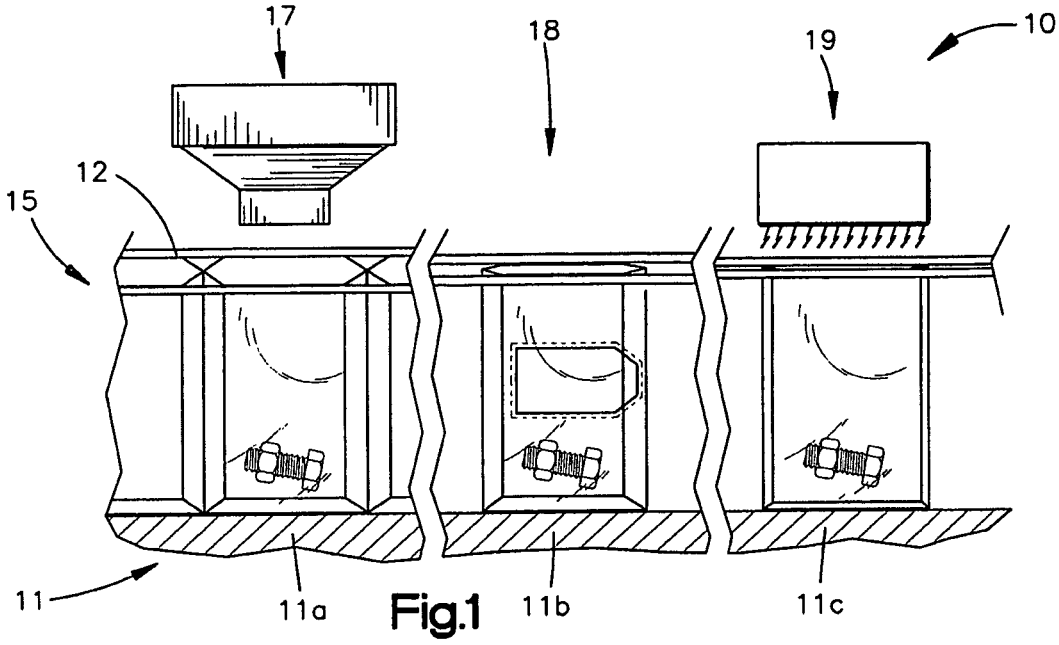
FIG. 1 is a foreshortened side elevational schematic view of a packaging machine.

Referring to FIG. 1, a packaging machine according to an exemplary embodiment of the invention is shown schematically at 10. The machine 10 includes a supporting frame (not shown) upon which a loading arrangement 17, a compressing arrangement 18, and a sealing arrangement 19 may be mounted. Examples of each are discussed in greater detail below. The supporting frame may further include a transport mechanism 12 (an example described in greater detail below) for moving a series of side connected bags or web 15 along a the supporting frame to each of the loading arrangement 17, compressing arrangement 18, and sealing arrangement 19. A supporting arrangement 11 may include support surfaces 11*a*, 11*b*, 11*c* along all or part of the support frame.

It may be desirable to compress the bags to remove or expel excess air from the bags prior to closure. By removing excess air from each bag, the subsequently sealed bag may occupy less space, thereby facilitating future storage and transportation. Further, a sealed bag containing less air may be less likely to split or tear as result of some impact, such as, for example, being dropped or being packed into a box or other container with other items, such as other sealed bags. The improved impact resistance may allow for the use of thinner bag or web material, which may enable substantial cost savings, particularly in high volume applications.

To compress the bags prior to closure according to an aspect of the present application, a packaging machine may utilize many different mechanisms or arrangements, such as, for example, clamps, rams, suctioning devices, rollers, or a narrowing track or gap into which the bag travels. In some applications, a bag compressing arrangement may accomplish both the removal of excess air from the bags and the facilitation of the return of the upper portions of the bag faces and backs into juxtaposition, thereby eliminating the need for a separate bag stretching arrangement. In other applications, the compressing arrangement may be provided in addition to or in combination with a bag stretching arrangement, such as, for example, one of the bag stretching arrangements described herein.

Figure 1A:
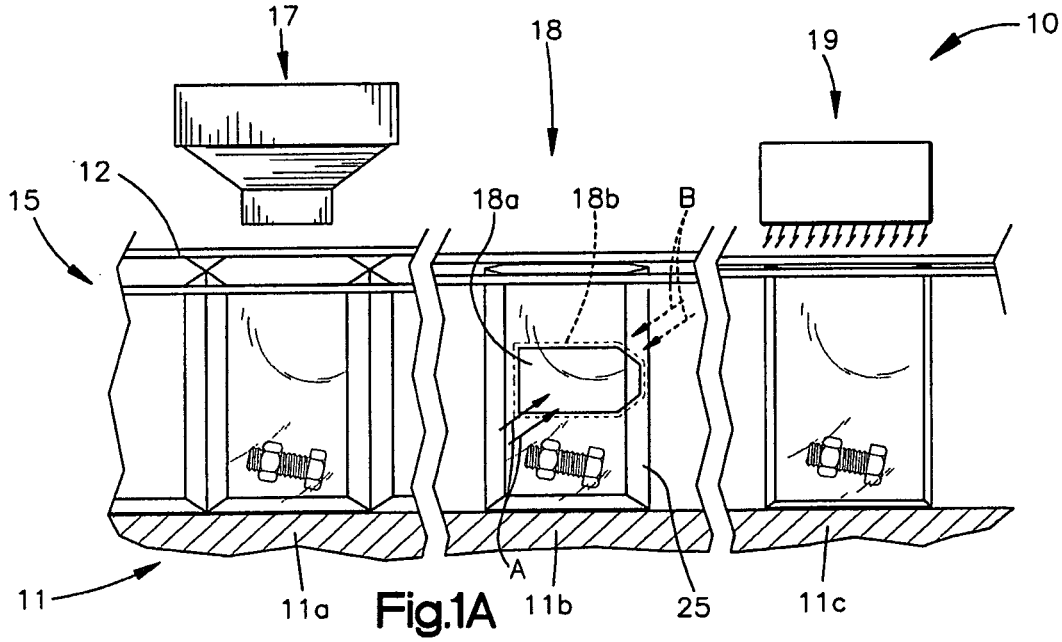
FIG. 1A is a foreshortened side elevational schematic view of a packaging machine.

Referring to the schematic illustration of FIG. 1A, in one embodiment, a bag compressing arrangement 18 may include a pair of compression members 18*a*, 18*b*, disposed on either side of a bag 25 to be compressed. The first compression member 18*a* may be movable with respect to the bag 25, shown by arrows A, such that the first compression member 18*a* compresses the bag 25 against the second compression member 18*b* to expel excess air from the bag 25. In one embodiment, the second compression member 18*b* is a stationary plate or obstruction. In another embodiment, the second compression member 18*b* is also movable with respect to the bag 25, shown by phantom arrows B, such that the first and second compression members 18*a*, 18*b* move towards each other to compress the bag 25.

Figure 1B:
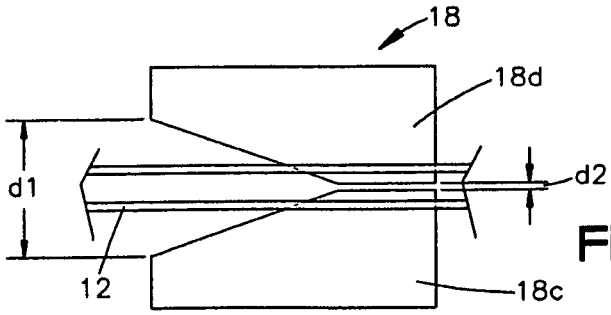
FIG. 1B is a top schematic view of a compressing arrangement for a packaging machine.

Referring to the schematic illustration of FIG. 1B, in one embodiment, a bag compressing arrangement 18 may additionally or alternatively include a pair of compression guides 18*c*, 18*d*, disposed on either side of a bag 25 to be compressed to define a channel or gap into which the bag is received. The compression guides 18*c*, 18*d* may be shaped or positioned such that the gap narrows from a first width d1, where the bag 25 is first received, to a second width d2, such that the bag 25 is compressed between the guides 18*c*, 18*d* as the bag 25 is transported therebetween. In such an embodiment, the compression guides need not (but may) be movable with respect to the bag 25. For example, the guides may be movable upward and downward with respect to the top and bottom of the bag.

According to another aspect of the present application, it may be desirable to provide support for the bottom of the bag during loading, compression, and/or sealing. If the bags are constructed from a thinner packaging material, forces applied to the sides or bottom of a bag, such as, for example, from heavier or sharper items being dropped into the bag or from compression of the sides of the bag to expel excess air, may cause the bag to tear or split. For example, support for the bottom-most portion of the bag at the loading arrangement may eliminate damage to the bag from deposited items. As another example, support for the bottom portion of the bag at the compressing arrangement may reduce tension in the sides of the bag during compression to prevent tearing or pulling of the top portion of the bag away from the transport mechanism. Support for the bottom portion of the bag at the sealing arrangement may prevent the heat sealed portion from sagging due to the weight of the deposited item or items.

As shown schematically in FIG. 1, in an exemplary embodiment, the packaging machine may be provided with a support surface beneath any or all of the loading, compressing, and sealing arrangements to provide support for a bottom portion of a bag being loaded. The support surface may be any type of plate, belt, extension, or other structure positioned to provide support for the bottom portion of the bag.

Under some circumstances, it may be desirable to use a supporting arrangement that provides support for a different amount of the bottom portion of the bags beneath each of the loading, compressing, and sealing arrangements. For example, as the forces applied to the bag at the loading arrangement may be limited to the force of the deposited item or items against the bottom of the bag, support for only the bottom-most portion of the bag may be desired, which may allow a deposited item or items to drop into the bottom-most portion of the bag. In contrast, rapid compression of the sides of the bag at the compressing arrangement may warrant additional support for the bottom portion of the bag to reduce tension in the sides of the bag resulting from the compressive forces.

Figure 1C:
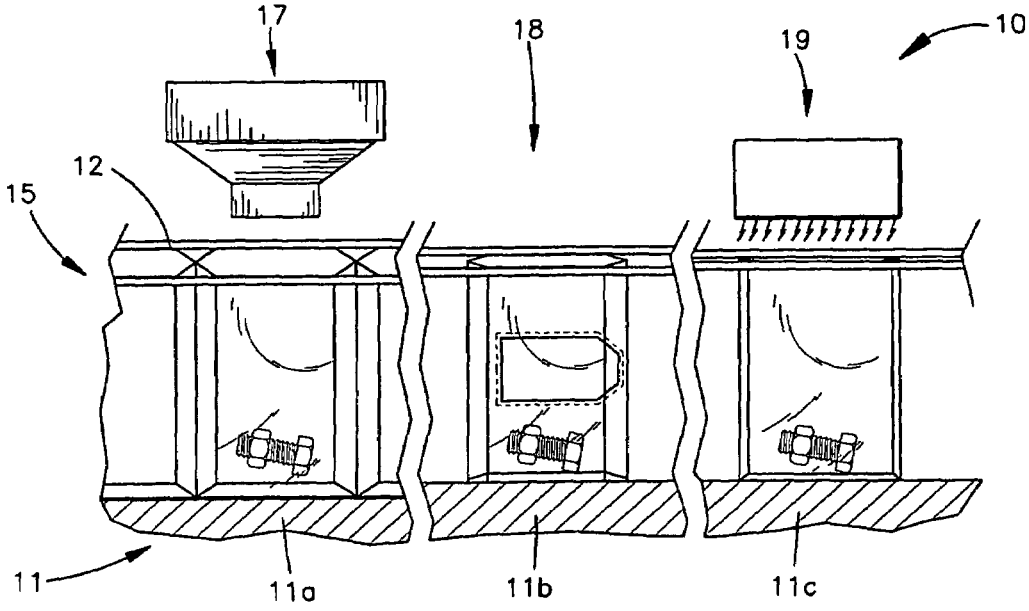
FIG. 1C is a foreshortened side elevational schematic view of a packaging machine.

In one embodiment, differing amounts of support may be provided by varying the position of the support surface with respect to the top portion of the bag along the path of travel over which the bag is transported as it is loaded, compressed, and sealed. Referring to the schematic illustration of FIG. 1C, an exemplary bag supporting arrangement 11 may include support surfaces 11*a*, 11*b*, 11*c* at the loading arrangement 17, compressing arrangement 18, and sealing arrangement 19, respectively, that are provided at different elevations to provide varying degrees of support for the bottom portion of the bag 25. In the exemplary schematic of FIG. 1C, support surfaces 11*b*, 11*c* beneath the compressing and sealing arrangements 18, 19 are elevated with respect to the support surface 11*a* beneath the loading arrangement 17. The varying elevations of the support surfaces 11*a*, 11*b*, 11*c* may be accomplished by using discrete surfaces that may be stepped or even separate from each other. Alternatively, the support surface 11*a*, 11*b*, 11*c* may be sloped or inclined between the loading arrangement and the compressing and/or sealing arrangements so as to increase support for the bottom portion of the bag as the bag travels through the packaging machine.

Figure 1D:
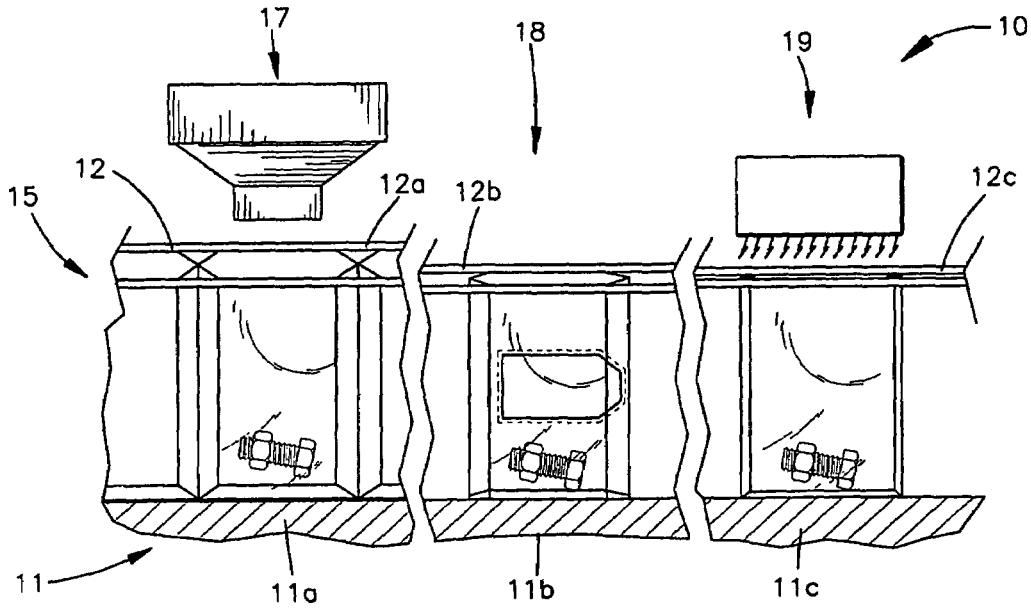
FIG. 1D is a foreshortened side elevational schematic view of a packaging machine.

In another embodiment, differing amounts of support may additionally or alternatively be provided by varying the position of the support surface with respect to the top portion of the bag along the path of travel over which the bag is transported as it is loaded, compressed, and sealed. Referring to the schematic illustration of FIG. 1D, an exemplary packaging machine may include a transport mechanism 12 that is adapted to hold the bag at different elevations with respect to the support surfaces 11*a*, 11*b*, 11*c* beneath the loading, compressing, and sealing arrangements 17, 18, 19. In the exemplary schematic of FIG. 1D, transport mechanism holding locations 12*b*, 12*c* at the compressing and sealing arrangements 18, 19 are lowered with respect to a transport mechanism holding location 12*a* at the loading arrangement.

Figure 2:
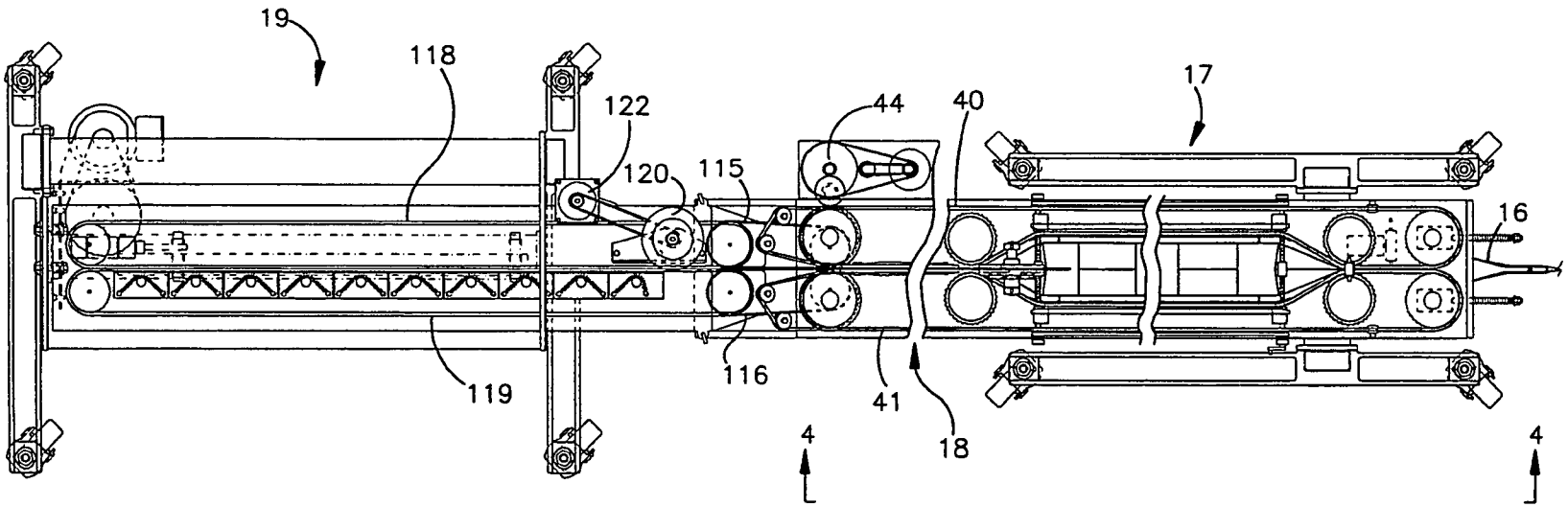
FIG. 2 is a top plan view of a packaging machine.
Figures 3, 6, 7:
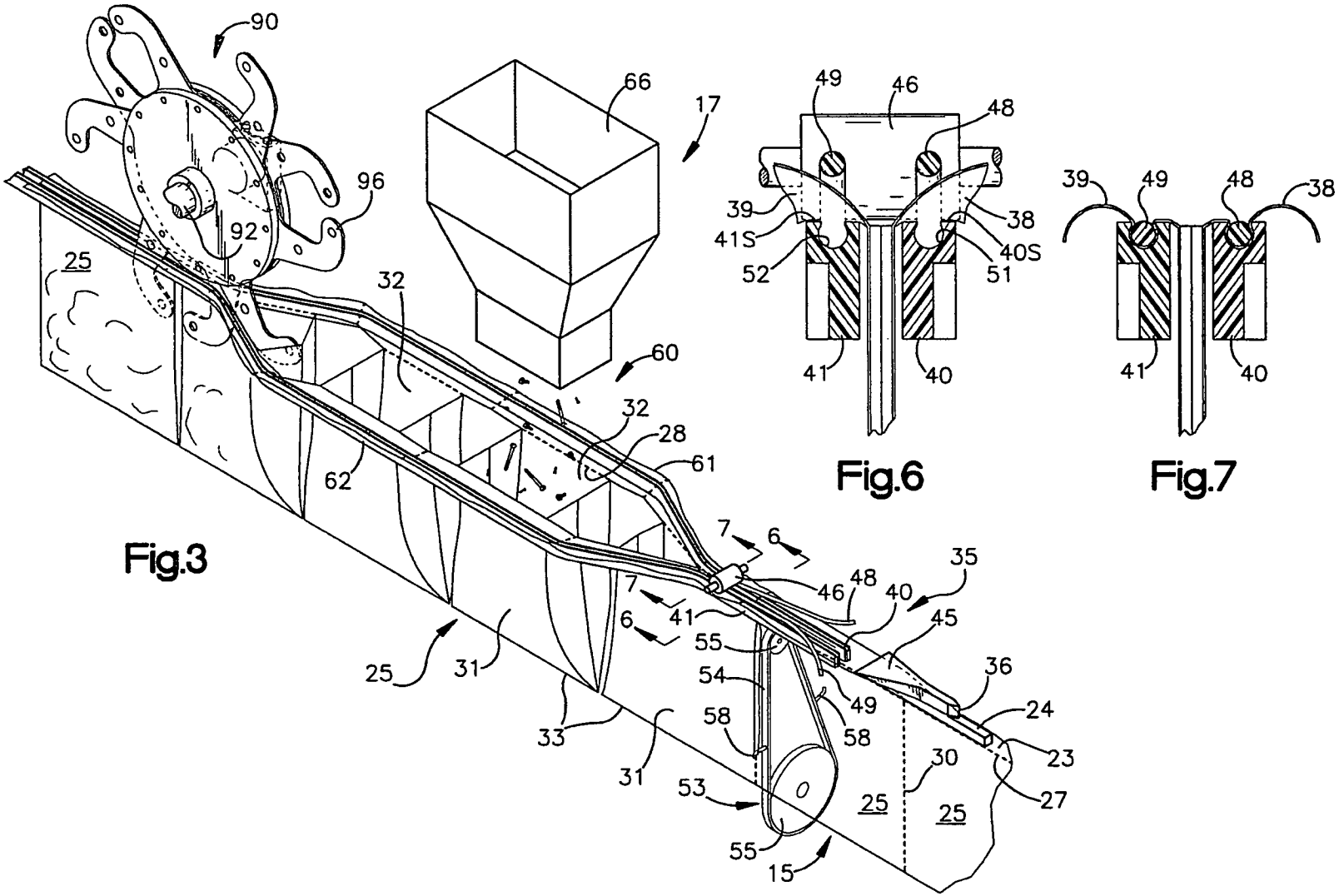
FIG. 3 is a perspective view of packaging machine transport belts transporting a bag web through a load station.
FIGS. 6 and 7 are enlarged sectional views from the planes respectively indicated by the lines 6-6 and 7-7 of FIG. 3.

FIGS. 2 and 3 illustrate one exemplary existing packaging machine with which the compressing and/or supporting arrangements can be used. Further details of this packaging machine are disclosed in the S P patent, referenced above. The support frame and compression arrangement can also be implemented in a wide variety of other packaging machines.

The machine illustrated in FIG. 2 includes an arrangement from which the chain of bags or web 15 is supplied. In the illustrated example of FIG. 2, the web 15 is fed from a supply shown schematically at 16 to a loading arrangement 17. The loading arrangement 17 is separably connected to a sealer section 19, by way of, for example, exit conveyors 115, 116.

In the drawings, the loading and closing arrangements are shown in their vertical orientations for gravity loading. The machine will be described in such orientation it being recognized that, as described more fully in section IV, the mechanisms may be positioned in a horizontal orientation and at other angular orientations. In one embodiment, as shown schematically in FIG. 2, a web supply platform 16 is provided at the back of the machine. The platform 16 is located to the right, as viewed in FIG. 2, under an entrance end of the load section.

II. Examples of a Web

The machines with compressing and/or supporting arrangements may be adapted to use many types of packaging bags, which may include separate bags, as well as chains of connected bags. In one embodiment, the machine is adapted for use with a chain or web of side connected bags. In the exemplary embodiment, the web 15 is an elongated flattened plastic tube, typically formed of polyethylene or other plastic material. The tube includes a top section 23 for feeding along a mandrel 24 (see FIGS. 3 and 5). The top section 23 is connected to the tops of a chain of side connected bags 25 by front and back lines of weakness in the form of perforations 27, 28. Frangible connections 30 connect adjacent bag side edges (see FIG. 3). Each bag 25 includes a face 31 and a back 32 interconnected at a bottom 33 by a selected one of a fold or a seal. Side seals adjacent the interconnections 30 delineate the sides of the bags 25. The bag faces and backs 31, 32 are respectively connected to the top section 23 by the lines of weakness 27, 28, such that the top section 23 when the web is flattened itself is essentially a tube. Additional details of acceptable webs of preformed bags may be found in U.S. Pat. Nos. 3,254,828, 4,344,557, 5,957,824, and 6,367,975, all of which are incorporated herein by reference in their entirety.

III. Examples of a Bagger Section/Loading Arrangement

A. Bag Feed and Preparation Portion

To prepare the bags for loading, the bags may be transported to the bag loading arrangement such that the top portion of each bag to be loaded is held open for depositing an item or items into the bag for packaging. In one embodiment, the web of bags may be provided with closed top ends, such that the top ends of the bags need to be cut or separated prior to loading. In the illustrated exemplary embodiment, the web 15 is fed from the supply 16 into a bag feed and preparation portion 35 of the bagger section 17. The feed is over the mandrel 24 and past a slitter 36 (see FIG. 3). The slitter 36 separates the top section 23 into opposed face and back lips 38, 39. The feed through the bag feed and preparation portion 35 is caused by a pair of endless, oppositely rotating, main transport belts 40, 41 supported by oppositely rotating pulley sets 42, 43. The main belts 40, 41 are driven by a stepper motor 44 (see FIG. 4) through toothed pulleys 42T, 43T of the sets 42, 43. Other of the pulleys 42S, 43S are spring biased by springs S (see FIG. 5) to tension the belts.

Figure 4:
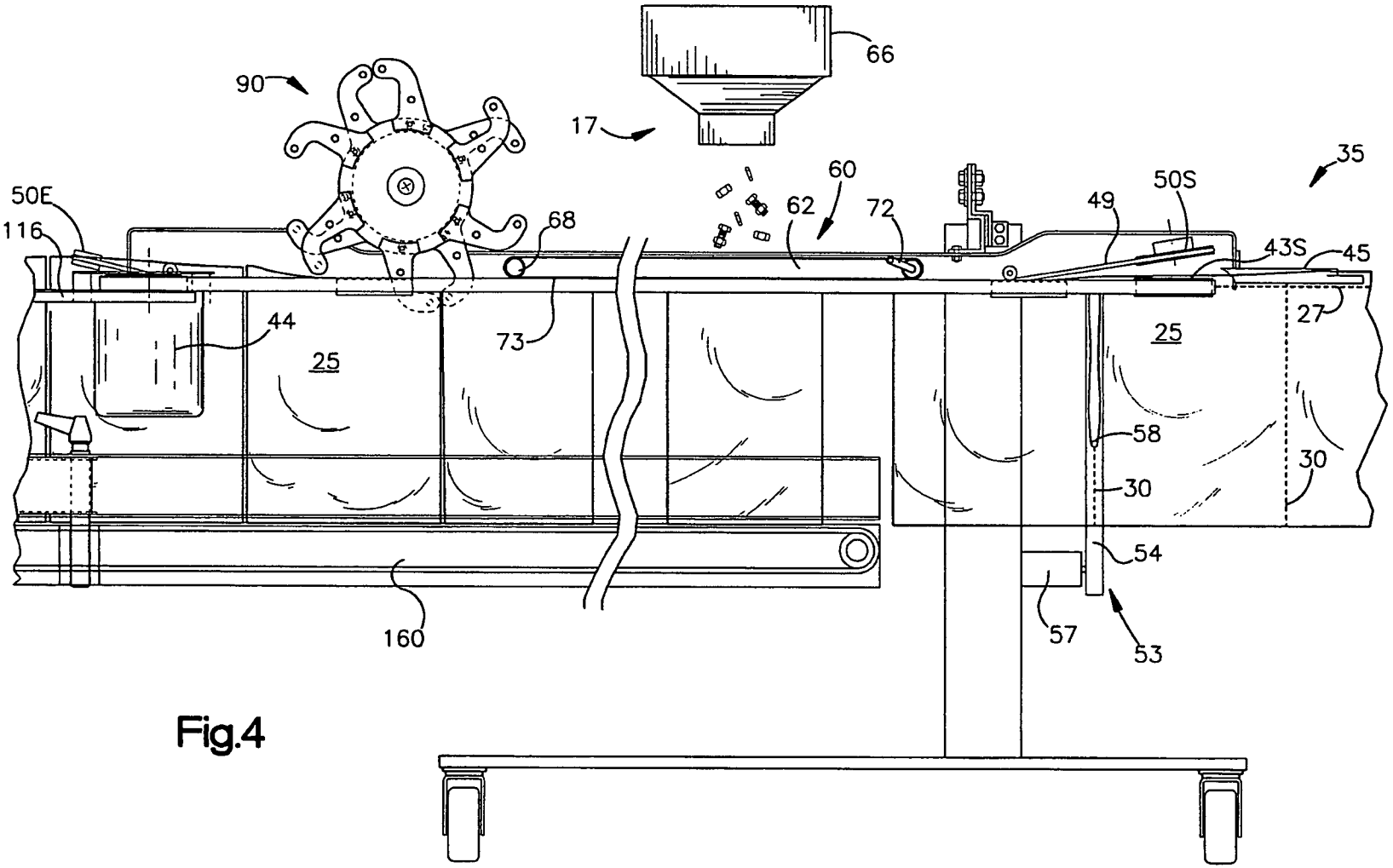
FIG. 4 is a foreshortened elevational view of a packaging machine bagger section as seen from the plane indicated by the lines 4-4 of FIG. 2.

The packaging machine may include many different mechanisms or methods for attaching the chain of bags to the transport belts, such as, for example, clips, pads, or other fasteners. In one embodiment, the lips or edges of the open top portions of the bags may be pressed into corresponding grooves in the transport belts to hold the top portions of the bags. FIGS. 3 and 4 illustrate a plow positioned a short distance upstream from a roller cam 46. As the lips are drawn along by the main transport belts 41, 42, the lips 38, 39 are respectively folded over the top bag engaging surfaces 41S, 42S, of the main transport belts under the action of the plow 45 as depicted in FIGS. 6 and 7.

Once the lips are folded over the tops of the main transport belts 41, 42, the roller cam 46 presses endless, lip transport and clamp belts 48, 49 into complemental grooves 51, 52 in the main transport belts 41, 42 respectively. Thus, the grooves 51, 52 function as bag clamping surfaces that are complemental with the clamping belts 48, 49. The camming of the clamp belts into the grooves traps the lips 38, 39 between the clamp belts and the grooves. Sections of the clamp belts which are not in the grooves 51, 52 are trained around a set of lip transport belt pulleys 50. Details of additional examples of transport belt arrangements are disclosed in the Load Belt Patent, which is incorporated herein by reference.

The packaging machine with a compressing arrangement and/or a support surface may be provided with many different mechanisms for separating each bag in the chain of bags from each other. In the example illustrated by FIGS. 2, 3, and 4, a bag side separator mechanism 53 is provided at a bag connection breaking station. The separator mechanism 53 includes an endless belt 54 which is trained around a pair of spaced pulleys 55 to provide spans which, as shown in FIGS. 3 and 4, are vertical. The pulleys 55 are driven by a motor 57 (see FIG. 5). As the belt 54 is driven, breaking pins 58 projecting from the belt 54 pass between adjacent sides of bags to break the frangible interconnections 30. Thus, as the bags depart the bag feed and preparation portion 35, they are separated from one another but remain connected to the lips 38, 39.

B. Example of a Load Station/Loading Arrangement

Figure 8:
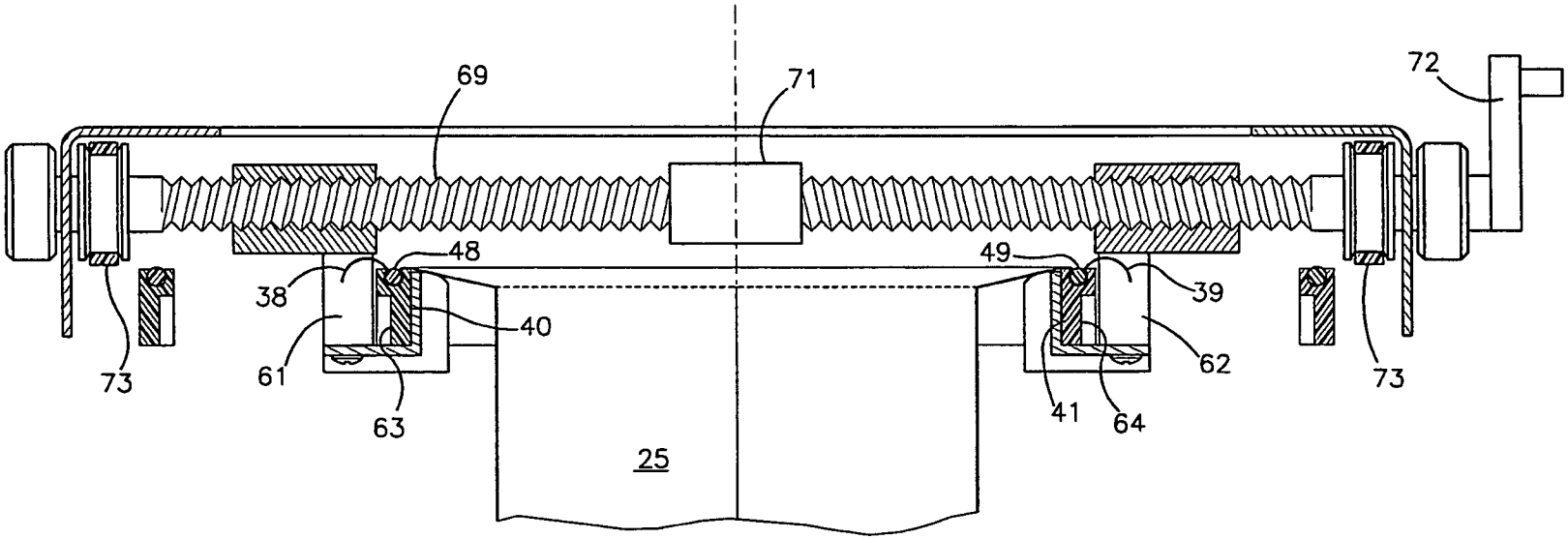
FIG. 8 is a sectional view of the transport belt spacing adjustment mechanism as seen from the plane indicated by the lines 8-8 of FIG. 5.
Figure 18:
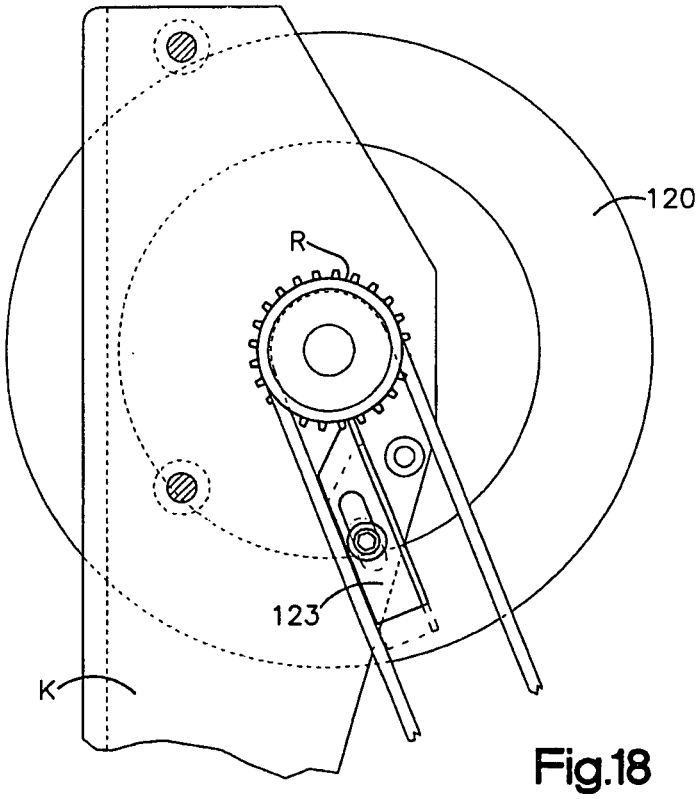
FIG. 18 is a view taken along the plane indicated by the line 18-18 of FIG. 27.

To open a bag for depositing an item or items for packaging, the packaging machine may be provided with any of several different mechanisms for holding the top portion of the bag open. In one embodiment, transport belts holding opposed sides of the bag top portion may separate from each other to a desired width to hold the bag open. In the example illustrated by FIG. 5, a loading arrangement 17 includes a pair of parallel belt spreaders 61, 62. The belt spreaders may be mirror images of one another. As is best shown in FIG. 18, the belt spreaders may include channels 63, 64. The channels 63, 64 respectively guide the main transport belts 40,41, on either side of the loading arrangement 17. When the transport belts 40,41, are in the channels 63, 64, as is clearly shown in FIGS. 3 and 8, the bags 25 are stretched between the belts in a rectangular top opening configuration.

Any arrangement or mechanism may be provided to deposit an item or items into the open bag. In one embodiment, a supply funnel may be positioned above the open bag to deposit the item or items into the bag by gravity feed. FIG. 3 provides a schematic illustration of a supply funnel 66. The products to be packaged may be deposited through the rectangular bag openings each time a bag is registered with the supply funnel at the load station.

A space or opening width adjusting mechanism may also be provided. In the example illustrated by FIG. 5, the space or width adjustment mechanism includes a spaced pair of adjustment screws 68, 69. The adjustment screws 68, 69 may be respectively centrally journaled by bearings 70, 71. The screws may have oppositely threaded sections on either side of their bearings 70, 71 which threadably engage the belt spreaders 61, 62. Rotation of a crank 72 causes rotation of the adjustment screw 69. The screw 69 is connected to the screw 70 via belts or chains 73, which function to transmit rotation forces so that when the crank 72 is operated the screws 68, 69 are moved equally to drive the spreaders equally into an adjusted spacial, but still parallel, relationship.

Figure 5:
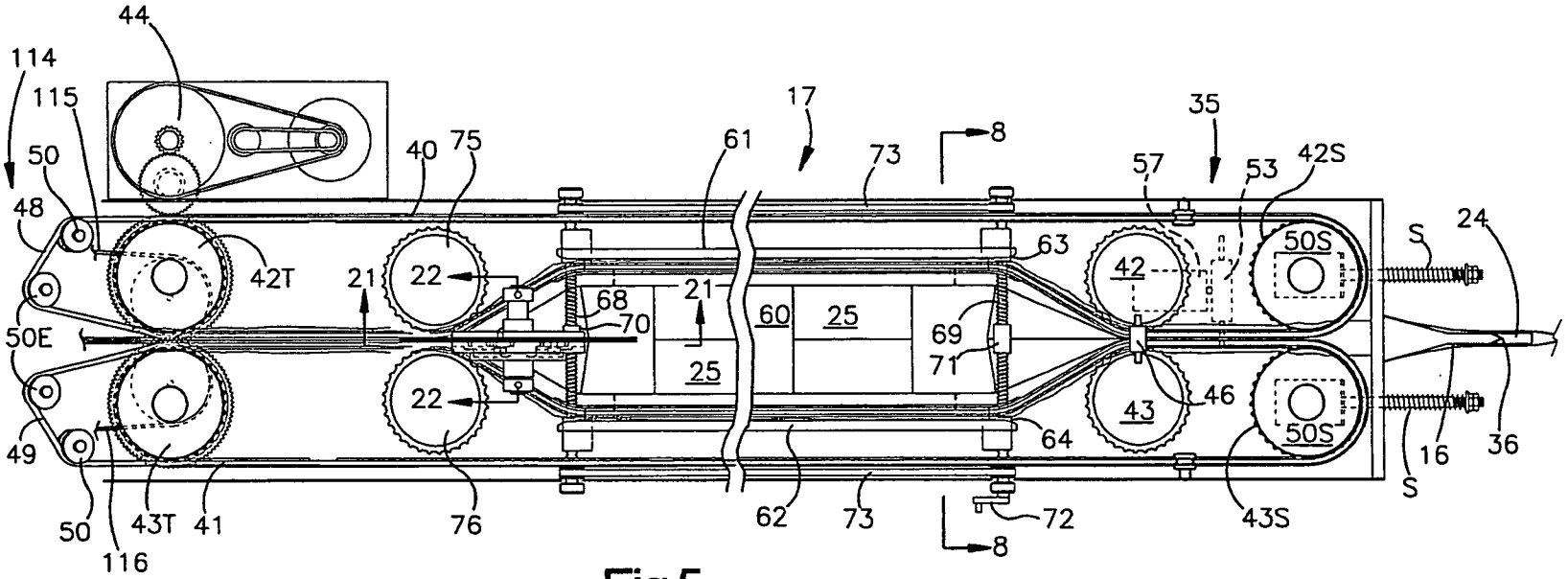
FIG. 5 is a fragmentary top plan view of a bagger section of the machine of FIG. 2.

In the example illustrated by FIG. 5, as the spreaders are movably adjusted toward and away from one another, the spring biased pulleys 42S, 43S maintain tension on the main transport belts 40, 41 while permitting relative movement of spans of the belts passing through the spreader channels 63, 64. Similarly, spring biased lip transport belt pulleys 50S maintain tension on the clamp belts 48, 49. The spring biased pulleys of both sets are the pulleys to the right as seen in FIG. 5, i.e. the entrance end pulleys in the bag feed and preparation portion 35.

The main transport pulley sets 42, 43 of the illustrated embodiment include two idler pulleys 75, 76 downstream from the load station 60. The idler pulleys 75, 76 are relatively closely spaced to return the main transport belts 40, 41 into substantially juxtaposed relationship following exit from the load station 60.

In one embodiment, part or all of the loading arrangement may be movable when in use from an operating position to an elevated position, to provide improved access to portions of the loading arrangement for cleaning or servicing of the loading arrangement components, for example. An exemplary embodiment of such an arrangement is disclosed in published co-pending application Ser. No. 10/738,694, entitled PACKAGING MACHINE AND PROCESS (the '694 application), incorporated by reference herein in its entirety.

C. Example of a Bag Stretching Arrangement

Figure 11:
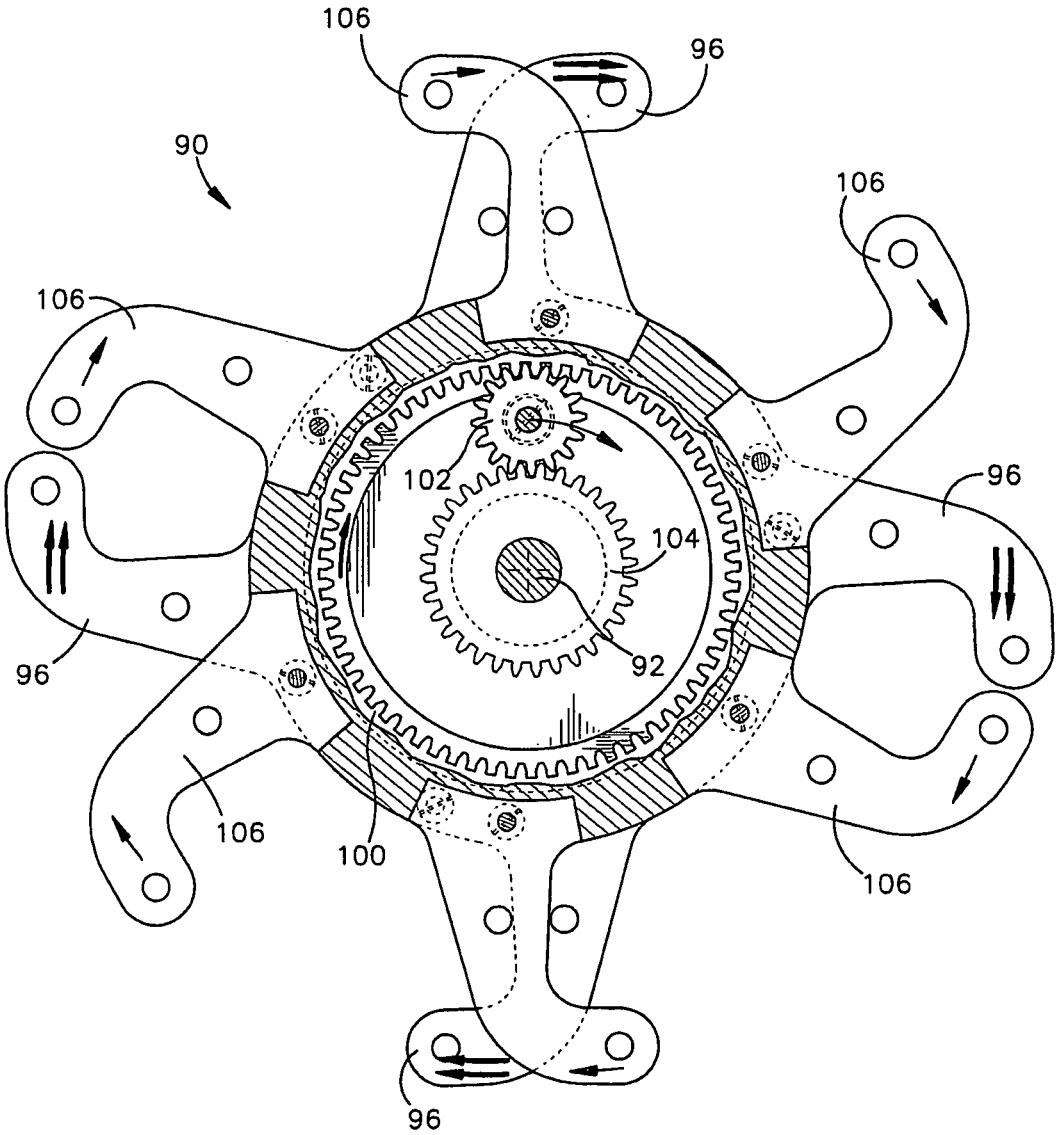
FIG. 11 is a sectional view of the bag flattening or stretching mechanism as viewed from the plane indicated by the lines 11-11 of FIG. 5.
Figure 12:
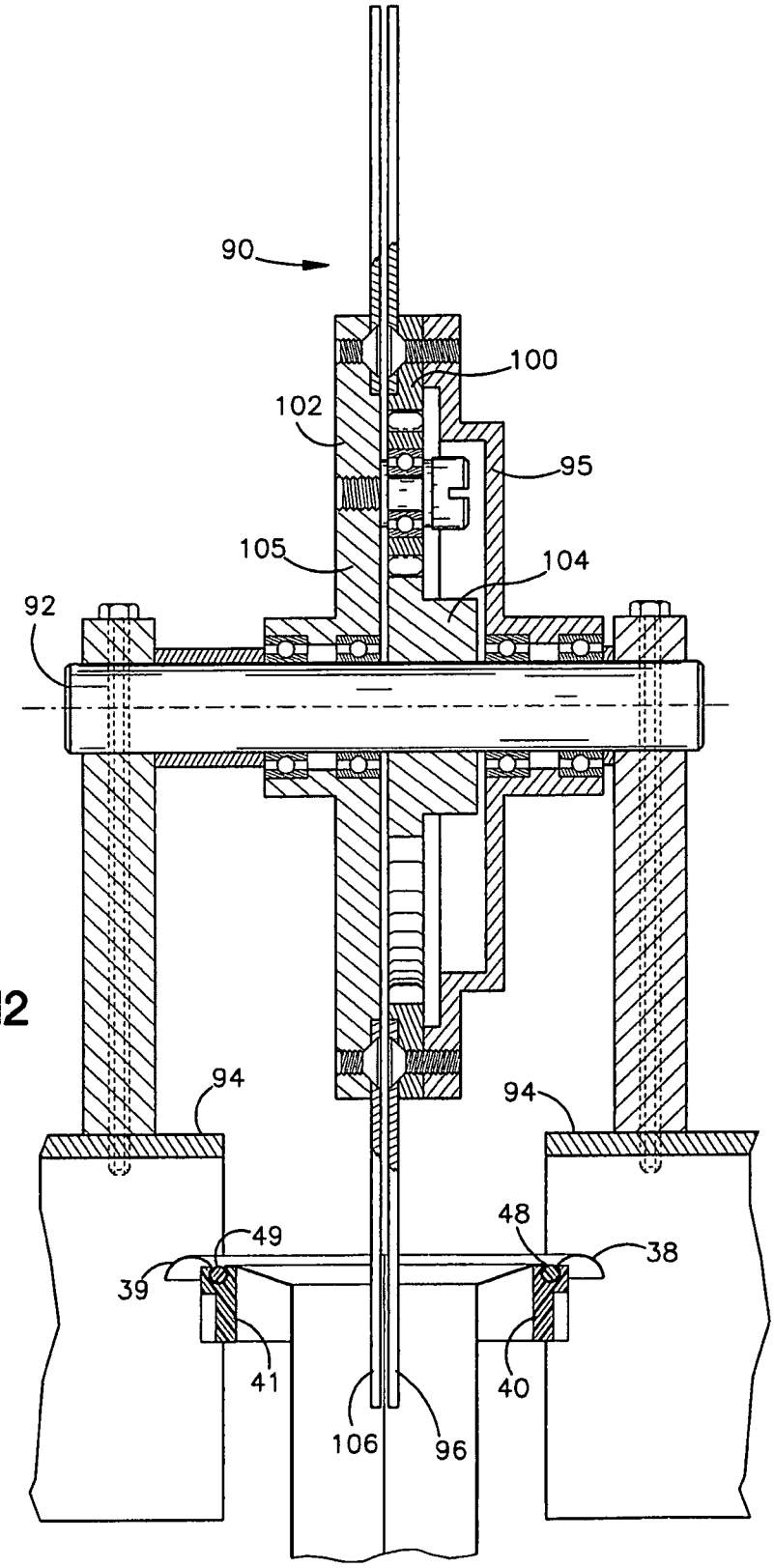
FIG. 12 is an enlarged sectional view of the mechanism of FIG. 11 as seen from the plane indicated by the lines 12-12 of FIG. 5.

As loaded bags exit the load station, it may be desirable to return upper portions of the bag faces and backs into juxtaposition. The machine of the present invention may employ many different mechanisms to stretch the bags such that the upper portions of the bag faces and backs are enabled to return to juxtaposition. One exemplary embodiment, used, for example, with smaller bags, includes a planetary stretcher 90. This planetary bag stretcher is best understood by reference to FIGS. 9, 11, and 12. The stretcher 90 includes a support shaft 92 mounted on frame members 94 of the bagger section, shown in FIG. 12.

Figures 9, 10:
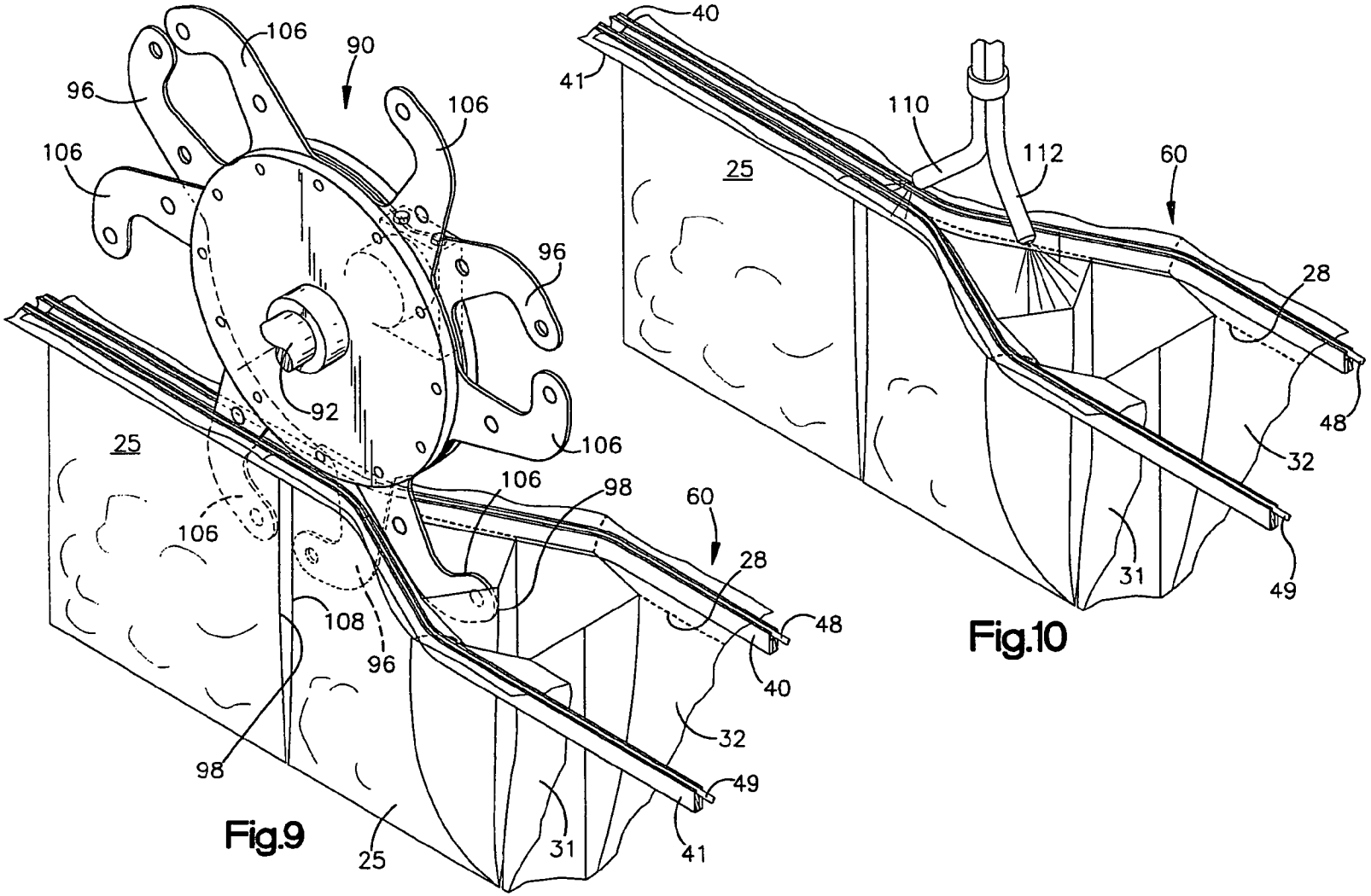
FIG. 9 is a perspective view of a portion of the bag flattening mechanism shown in FIG. 3.
FIG. 10 is a perspective view showing an alternate arrangement to the mechanism of FIG. 9 for flattening bags.

The planetary stretcher may include a bag trailing edge engaging element 95. The exemplary element 95 includes six bag engaging fingers 96. As is best seen in FIGS. 3 and 9, one of those fingers 96 is shown in a lead one of the bags 25 while the next finger is being moved into the next bag in line as the next bag departs the load station 60. As the bags move from right to left as viewed in FIG. 9, an internal ring gear portion 100 drives a planet gear 102. The planet gear orbits a fixed sun pinion 104. The planet gear 102 is journaled on and carried by a lead edge engaging element 105 journaled on the shaft 92. The lead edge engaging element 105 has four fingers 106 which orbit at one and a half times the rate of the fingers 96. Rotation of the lead edge engaging element causes one of the fingers 106 to enter the next bag as it exits the load station and to engage a leading edge 108 of the bag, thereby stretching the bag until top portions of the bag face and back are brought into juxtaposition.

In another embodiment of the bag stretching device, illustrated in FIG. 10 and used, for example, with larger bags, the stretching of the loaded bags as they exit the load station may be accomplished with jets of air from nozzles, 112. The nozzles 110, 112 respectively blow air against the lead and trailing edges of the bag, thus stretching the bags from their rectangular orientation into a face to back juxtaposed relationship as the transport belts are returned to juxtaposition.

D. Bag Compression

Figure 13A:
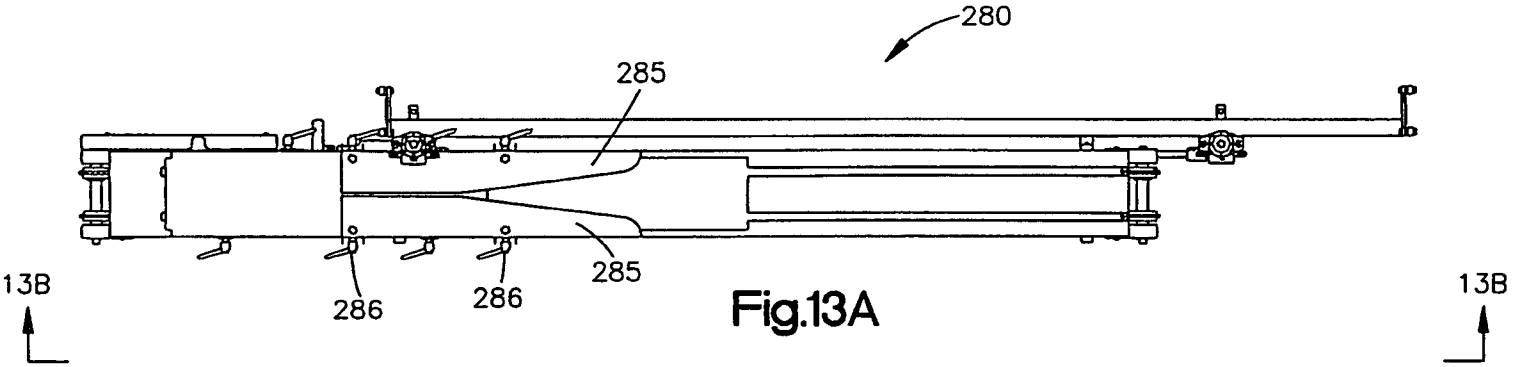
FIG. 13A is a top view of a bag compressing arrangement of a packaging machine.
Figure 13B:
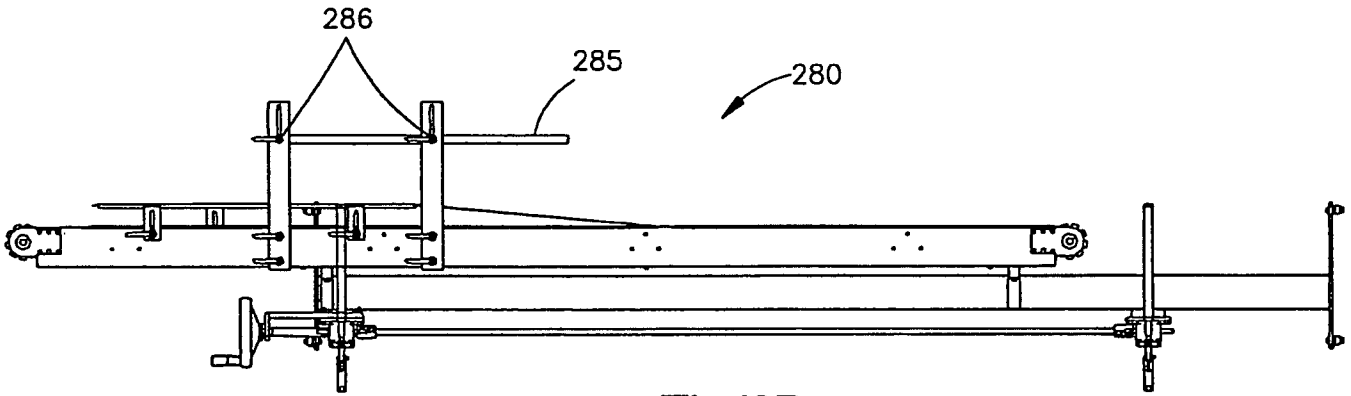
FIG. 13B is a side view taken along lines 13B-13B of FIG. 23A.

In one embodiment, as illustrated in FIGS. 13A and 13B, a pair of opposed wedge shaped guides 285 may be provided to receive the bag as the bag is transported from the loading arrangement 17 to the closing arrangement 19 (see FIG. 1). The guides 285 may be positioned such that the gap into which the bag is received becomes narrower as the gap approaches the closing arrangement, effectively compressing the portion of the bag between the guides 285 to expel air from the open top portion of the bag. Further, as shown in FIGS. 13A and 13B, the guides 285 may be provided with adjustment clamps 286 to adjust the vertical position of the guides 285 with respect to the support frame to adjust the portion of the bags 25 to be compressed. By adjusting the guides 285 to be positioned slightly above the top of the loaded item in the bag, the amount of air expelled may be maximized without risking damage to the loaded item. In another exemplary embodiment (not shown), the guides may be made larger to receive and compress a larger portion of the loaded bags.

Figure 14:
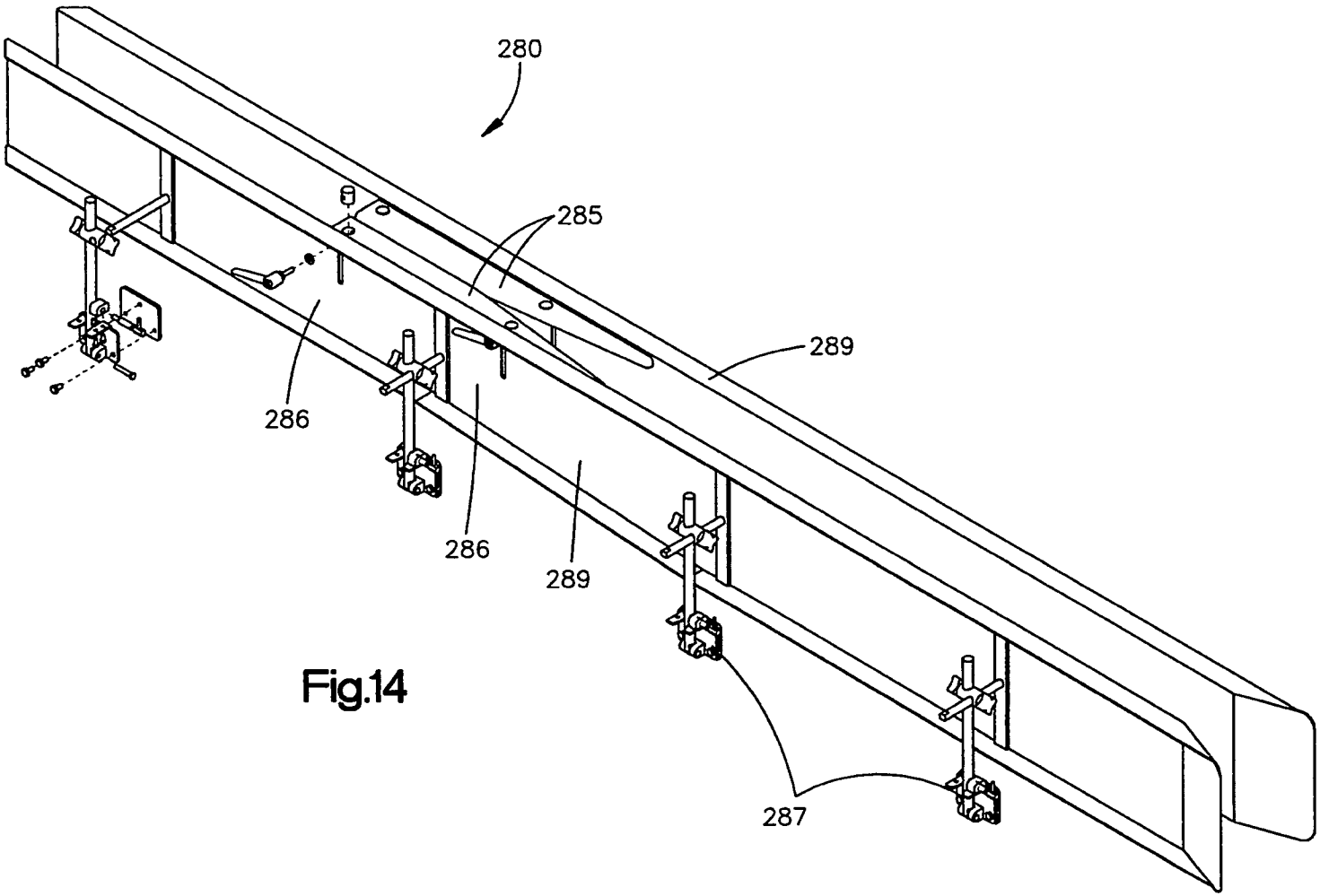
FIG. 14 is a perspective view of another bag compressing arrangement of a packaging machine.

In another embodiment, as shown in FIG. 14, the guides 285 may be provided between support walls 289, which may provide additional support for the loaded bags, as well as compression of the bags prior to the bags reaching the guides. Mounting equipment 287 may be provided to mount the walls 289 and guides 285 to a frame of the packaging machine. As with the embodiment of FIGS. 13A and 13B, adjustable clamps may be used to adjust the position of the guides 285.

Figure 15A:
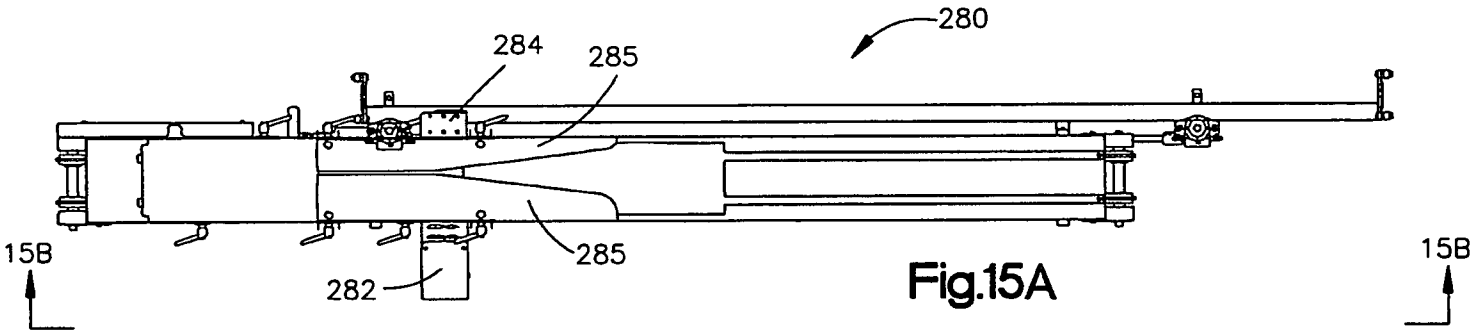
FIG. 15A is a top view of another bag compressing arrangement of a packaging machine.
Figure 15B:
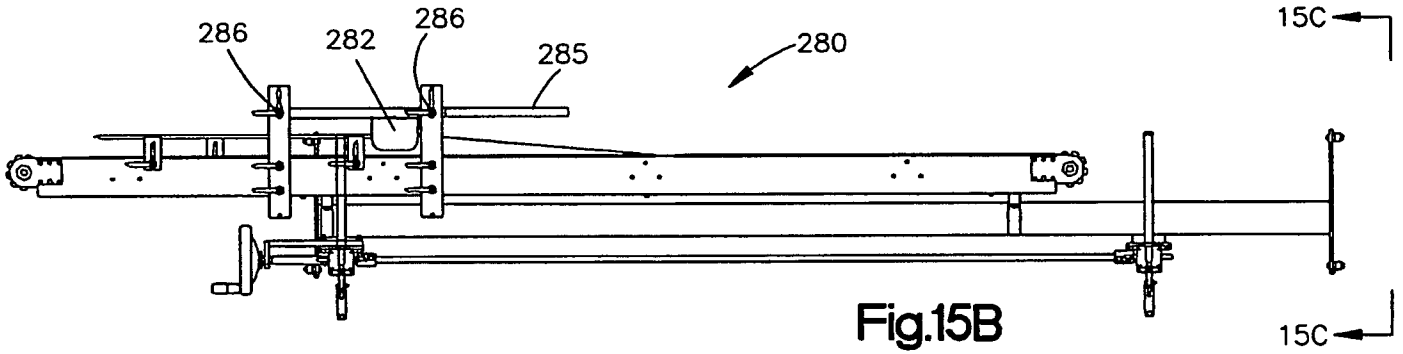
FIG. 15B is a side view taken along lines 15B-15B of FIG. 15A.
Figure 15C:
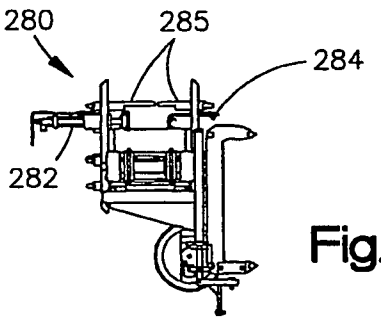
FIG. 15C is an end view taken along lines 15C-15C of FIG. 15B.

In another embodiment, as shown in FIGS. 15A-C, the compressing arrangement 280 may additionally or alternatively include a press or ram 282 on one side of the bag transport mechanism and a stationary wall or plate 284 opposite the ram 282 on the other side of the bag transport mechanism. When the uncompressed, loaded bag is positioned between the ram 282 and the plate 284, the ram, which may be powered electrically, pneumatically, or by some other means, may be operated to compress the bag 25 between the ram 282 and the plate 284, causing excess air in the bag to be expelled through the open top portion. In another embodiment (not shown), two opposing rams may be used to compress the bag. As shown, the ram 282 and plate 284 may be used in combination with another compressing mechanism, such as, for example, the wedge shaped guides 285 of FIGS. 13A and 13B, to more effectively compress air from the unsealed bags. In the illustrated embodiment, the ram 282 and plate 284 are positioned toward the trailing end (narrow gap) of the guides 285, to expel excess air still remaining in the bag 25 after the bag has been compressed by the guides 285. However, other orientations or positioning of this combination of compressing mechanisms may also be used.

E. Example of a Transfer Location/Transport Mechanism

Figure 16:
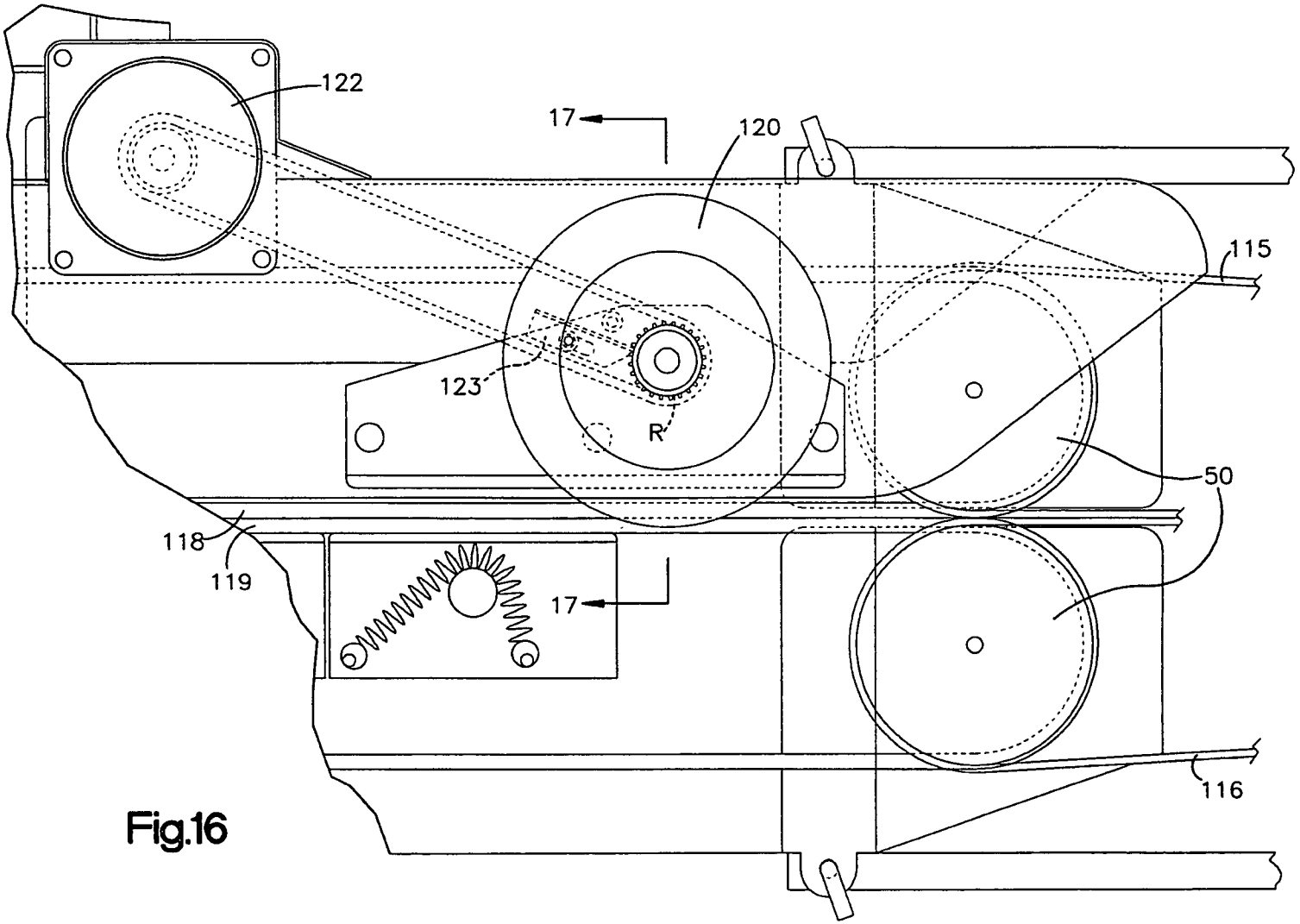
FIG. 16 is an enlarged fragmentary plan view of a transfer mechanism between the bagger and the closure sections, including a knife for trimming the tops of loaded bags prior to closure.

Referring to FIG. 16, after excess air has been compressed from the loaded bags, and the face and back of each bag have been brought into juxtaposition, the loaded bags may be transferred to the closure section 19 (see FIG. 2).

Figure 17:
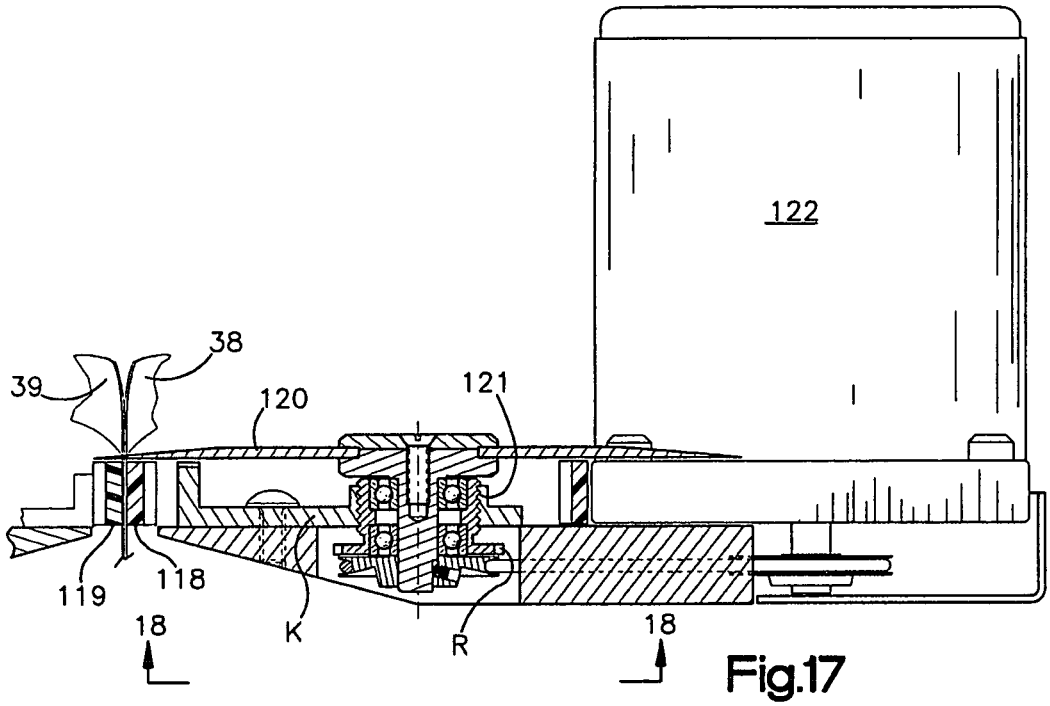
FIG. 17 is a sectional view taken along the plane indicated by the lines 17-17 of FIG. 16.

In some embodiments, the upper portions or lips of the bags may be cut off or otherwise removed before or after closure of the bags. In the illustrated embodiment, as shown in FIGS. 16-18, a rotary knife 120 is positioned a short distance downstream from the exit conveyors. The knife is rotatively mounted in an externally threaded support tube 121. The tube in turn is threadedly connected to a knife support frame section K. An adjustment lock 123 is slidably carried by the frame section K. When the lock 123 is in the position shown in solid lines in FIG. 18, it engages a selected one of a plurality of recesses R in the perimeter of the support tube 121 to fix the knife in an adjusted height position. When the lock 123 is slid to the phantom line position of FIG. 18, the tube 121 may be rotated to adjust the vertical location of the knife 120.

The knife 120 may be driven by a motor 122 to sever the bag lip portions 38, 39, leaving only closure parts of the lip portions for closure, in the disclosed arrangement, by heat sealing. The trimmed plastic scrap from the severed lip portions may be drawn from the machine with a conventional mechanism, not shown, and thereafter recycled.

IV. Example of a Closure Section/Closing Arrangement

A machine with a compression arrangement and/or a support arrangement may be adapted to use many types of closing or sealing arrangements, including, for example, stapling, crimping, and heat sealing. Additionally many different mechanisms may be employed to hold the top portions of the bags together for sealing. In the example illustrated in FIG. 2, seal station belts 118, 119 hold the bags closed and heat is applied to the bags to seal the bags. Additional details of examples of acceptable closing arrangements can be found in the S P and Sealer Belt Patents referenced above.

V. Support Conveyor/Support Surface

Figure 19:
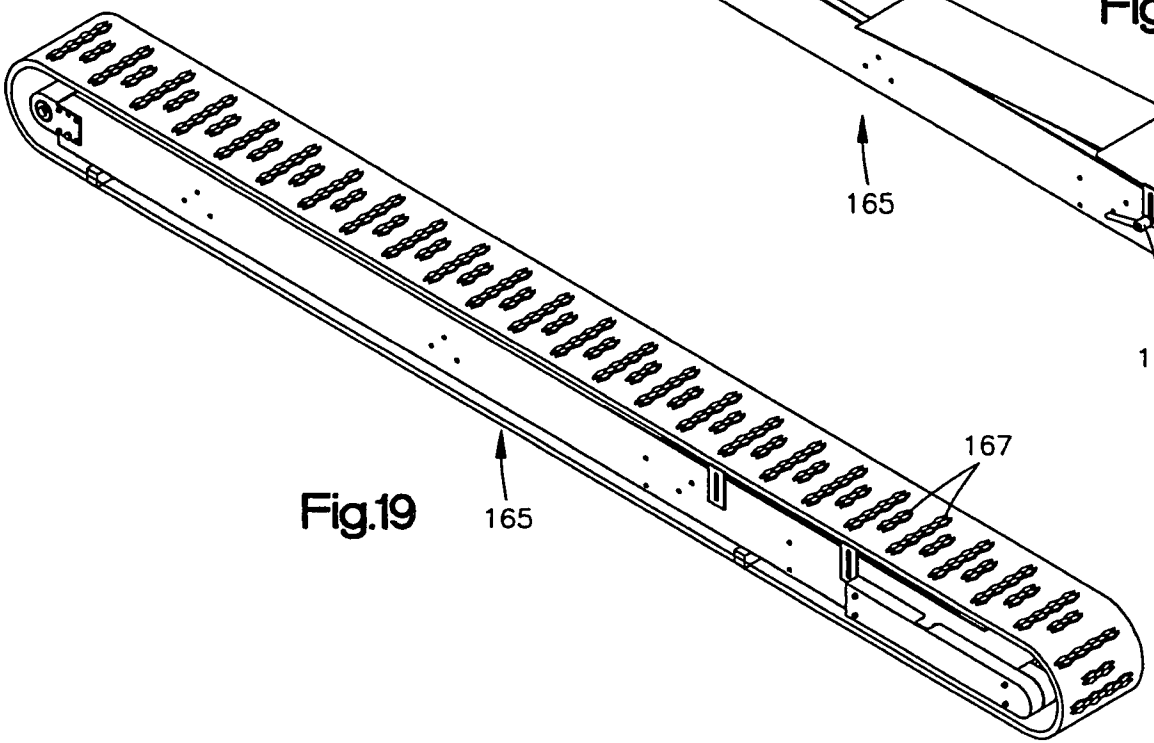
FIG. 19 is a perspective view of a support conveyor.

In the illustrated embodiment of FIG. 19, the support surface 160 is provided on a support conveyor 165 disposed beneath the transport mechanism. This conveyor belt may, but need not, be powered by its own motor to move at a speed that is consistent with the speed of the transport belts. In some embodiments the support conveyor 165 may be provided with a ribbed or textured surface 167 to prevent the bottom of the bag from slipping off of the moving conveyor. FIG. 19 illustrates one embodiment of a support conveyor surface having cup-like protrusions, which may help prevent round or cylindrical deposited items from rolling within the loaded bag, which may cause the bottom of the bag to slip off of the support conveyor. A rubber support conveyor surface may also assist in retaining the bottom of the bag on the support conveyor surface.

Figure 20:
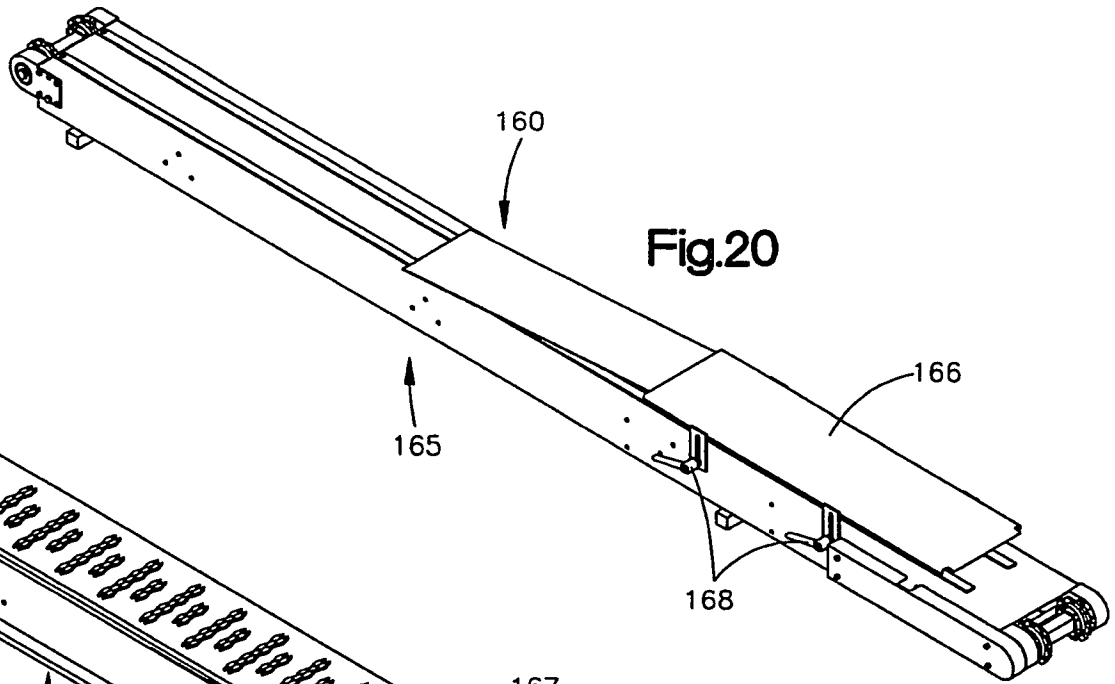
FIG. 20 is a perspective view of another support conveyor.

In the illustrated embodiment of FIG. 20, the conveyor 165 providing the support surface 160, shown without a conveyor belt for clarity, is inclined to provide additional support for the bottom portion of each bag at the compressing and sealing arrangements. While the difference in elevation or the angle of inclination of the support surface may vary depending on the size of the bags, the thickness and strength of the bag material, the type of compressing arrangement used, and the size and weight of the items being deposited, among other factors, in one exemplary embodiment the support surface beneath the compressing arrangement may be elevated approximately one half inch to one inch with respect to the support surface beneath the loading arrangement. In one embodiment, as illustrated in FIG. 20, an elevated portion 166 of the support conveyor 165 may be vertically adjustable, by using, for example, adjustment clamps 168, to vary the angle of incline and/or change in elevation between the support surface at the loading arrangement and the support surfaces at the compressing and closing arrangements.

VI. Operation

In operating an exemplary compressing arrangement, a loaded bag is transported to a compressing location. One or more bag compressing members engage side walls of the bag to expel excess air from an open or unsealed end of the bag. Engagement of bag compressing members with the side walls may involve movement of the bag into engagement with the bag compressing members, such as, for example, movement of the bag between wedge or ramp shaped guides. Engagement of bag compressing members with the side walls may additionally or alternatively involve movement of bag compressing members into engagement with the bag, such as, for example, the extension of a ram or plunger against the bag to compress the bag against an opposed plate, ram, or other such structures.

In utilizing an exemplary supporting arrangement, a support surface may be provided beneath a bag at one or more of a loading, compressing, and sealing arrangements. The support surface, which may be provided on a frame of a packaging machine, provides support for at least a bottom most portion of the bag. As the bag is transported from the loading arrangement to the compressing arrangement, the portion of the bottom of the bag supported by the support surface is increased, to reduce tension in the sides of the bag resulting from compression of the bag. To provide additional support for the bag, the support surface may be inclined with respect to a held top portion of the bag, or alternatively, the held portion of the bag may be declined with respect to the support surface.

In operating the machine shown in the illustrated example embodiments, a web 15 of bags 25 is fed through the bagger and sealer. The transverse spacing of the main conveyor belts 40, 41 is adjusted by rotating the crank 72 until the load station 60 has the desired transverse dimension. The top section of the web 15 is fed along the mandrel 24 and slit by the slitter 36. This forms the lips 38, 39 which are folded over the main transport belts 41, 42 by the action of the plow 45. The lip clamp belts 48, 49 are cammed into the transport belt recesses 51, 52 to clamp the bags in the belts.

As adjacent runs of the transport belts 41, 42 progress downstream from the bag feed and preparation portion 35, the belts are spread under the action of the belt spreaders 61, 62. As the belts are spread, the lips 38, 39 cause the front and back faces 31, 32 adjacent the lead edge of each bag to separate from the lips 38, 39 by tearing a sufficient length of the perforations between them to allow the lead edge to become the mid point in a bag span between the belts as the bag passes longitudinally through the load station 60. Similarly, the perforations adjacent the trailing edge are torn as the trailing part of the bag is spread until the bag achieves a full rectangular opening as shown in FIG. 3.

Next a product is inserted into the rectangular bag as indicated schematically in FIG. 3. While the schematic showing is of discrete fasteners, it should be recognized that this machine and system are well suited to packaging liquids and bulky products which must be stuffed into a bag, such as pantyhose and rectangular items, such as household sponges. In one embodiment, at the load station 60, the bottom most portion of the bag is supported by the support conveyor 165, preventing the dropped item both from damaging the bottom of the bag and from pulling the top portion of the bag loose from the transport belts.

After the product has been inserted, the adjacent runs of the main transport belts are brought back together and the loaded bag tops are spread longitudinally of the path of travel either by the planetary stretcher 90 or opposed air streams from nozzles 110, 112.

The transport belts then feed the loaded bags between the wedge shaped guides 165, which compress the bags 25 to remove excess air from the bags. The ram 162, positioned below the guides 165, is then powered to compress the bag between the ram 162 and the plate 164, further expelling excess air from the top of the bag 25. The inclined support conveyor 165 provides additional support for the bottom of the bag during compression by reducing the distance between the support surface 160 and a held top portion of the bag 25, to reduce tension in the sides of the bag and prevent damage and/or detachment.

As is best seen in FIG. 4, exit ones 50E of the lip belt pulley set are spaced from the main transport belt and rotatable about angular axes. When the machine is in a vertical loading orientation, the pulleys 50E are above the main transport belt such that the lip transport belts are pulled from the grooves 51, 52.

The now loaded bags pass through the transfer location onto the exit conveyors 115, 116 and thence to the seal station belts 118, 119, which hold the bags closed. At this juncture the scrap is severed from the loaded bags by the action of the knife 120. As the bags are advanced through the sealer section, the portions of the bags held closed by the seal station belts are heated to seal the bags.

Although the invention has been described in its preferred form with a certain degree of particularity, it is understood that the present disclosure of the preferred form has been made only by way of example and that numerous changes in the details of construction, operation and the combination and arrangement of parts may be resorted to without departing from the spirit and the scope of the invention as hereinafter claimed.

We claim:

1. A method of forming packages from a chain of side connected bags comprising:

preforming the chain of side connected bags, wherein each side connected has opposing sidewalls that are interconnected at a bottom by one of a fold and a seal and at spaced apart sides by side seals;

holding top end portions of the preformed bags open with belts that comprise main transport belts and lip belts by folding the top end portions over the main transport belts and pressing the lip belts into recesses in the main transport belts to clamp the top end portions of the preformed bags;

positioning the each preformed bag at a first location where the closed bottom portion is supported at a first vertical distance below the open end;

depositing an item into each preformed bag through the open top end portion at the first location;

transporting each preformed bag to a second location after said item is deposited into the preformed bag, wherein the bottom end portion of the preformed bag is supported at a second vertical distance below the open end;

as each bag is transported to the second location and after said item is deposited into the preformed bag, contacting an exterior surface of the sidewalls below and spaced apart from a lowermost surface of said main transport belts and lip belts and above the closed bottom portion of the bag in which the item rests with a pair of horizontally spaced guide surfaces, wherein a distance between the guide surfaces narrows in a direction from the first location toward the second location; and sealing the open top end portion of each compressed bag to form a package.

2. The method of claim 1, further comprising ramping the support surface upward from the first location to the second location.

3. The method of claim 1, wherein holding the top end portion of the bag open comprises gripping opposed lips on the top portion of the at least one bag and spreading the lips apart.

4. The method of claim 1, further comprising closing the top end portion of the bag by gripping opposed lips on the top portion of the at least one bag and drawing the lips together.

5. A method of forming packages from a chain of side connected bags comprising:

preforming the chain of side connected bags, wherein each side connected has opposing sidewalls that are interconnected at a bottom by one of a fold and a seal and at spaced apart sides by side seals;

holding top end portions of the preformed bags open with belts that comprise main transport belts and lip belts by folding the top end portions over the main transport belts and pressing the lip belts into recesses in the main transport belts to clamp the top end portions of the preformed bags;

positioning each preformed bag at a first location;

depositing an item into each preformed bag through the open top end portion at the first location;

transporting the each preformed bag from the first location to a second location;

contacting an exterior surface of the sidewalls at the second location below a lowermost surface of the main transport belts and lip belts and above the bottom of the preformed bag in which the item rests with first and second compressing members while said sidewalls are substantially upright;

moving at least one of the first and second compressing members toward the other to compress the preformed bag at the second location; and sealing the open top end of the compressed bag.

6. The method of claim 5, wherein the support surface is ramped upward from the first location to the second location.

7. The method of claim 5, further comprising ramping the support surface upward from the first location to the second location.

8. The method of claim 5, wherein holding the top end portion of the at least one bag open comprises gripping opposed lips on the top portion of each bag and spreading the lips apart.

9. The method of claim 5, further comprising closing the top end portion of each bag by gripping opposed lips on the top portion of the at least one bag and drawing the lips together.

10. A packaging machine for forming packages from a chain of side connected bags, the machine comprising:

a supply of the chain of side connected bags, wherein the side connected bags are preformed with each bag having opposing sides that are interconnected at a bottom by one of a fold and a seal and at spaced apart sides by side seals;

a transport mechanism for moving the preformed chain of bags that are supplied to the transport mechanism from the supply along a path of travel, wherein the transport mechanism comprises a plurality of belts and a belt spreader, wherein the plurality of belts comprise main transport belts and lip belts, wherein the main transport belts include recesses that the lip belts are cammed into to clamp edges of the chain of bags in the transport mechanism belts, wherein the belt spreader is adapted to open a top end of a bag in the chain of bags for depositing an item to be packaged into the open top end;

a support surface positioned to support the bottom of the preformed chain of bags below the top end as the preformed chain of bags is moved along the path of travel, wherein the belt spreader is disposed along the path of travel above a first portion of the support surface;

a bag sealing arrangement for sealing the open end of the bag, the bag sealing arrangement being disposed along the path of travel downstream from the belt spreader; and a bag compressing narrowing guide arrangement for compressing said opposing sides of the preformed bag to remove excess air from the preformed bag prior to sealing the open top end of the preformed bag, the bag compressing narrowing guide arrangement being disposed along the path of travel above a second portion of the support surface and between the belt spreader and the bag sealing arrangement, the bag compressing narrowing guide arrangement comprising a pair of horizontally spaced compressing surfaces configured to compress exterior surfaces of said opposing sides of the preformed bag, wherein the compressing surfaces are below and spaced apart from a lowermost surface of the main transport belts and lip belts of the transport mechanism and above and spaced apart from said bottom of said preformed chain of bags, the compressing surfaces being angled toward one another to act upon the exterior surface of the opposing sides of the preformed bag to move the sides of the preformed bag toward one another as the preformed bag moves through the bag compressing narrowing guide arrangement, wherein a distance between the compressing surfaces narrows in a direction from the belt spreader toward the sealing arrangement.

11. The packaging machine of claim 10, wherein the support surface is inclined between the first portion and the second portion.

12. The packaging machine of claim 10, wherein the support surface comprises a conveyor belt.

13. The packaging machine of claim 10, wherein the plurality of belts are adapted to close a top portion of a bag in the chain of bags after an item has been deposited in the bag.

14. A packaging machine for forming packages from a chain of side connected bags, the machine comprising:

a supply of the chain of side connected bags, wherein the side connected bags are preformed with each bag having opposing sides that are interconnected at a bottom by one of a fold and a seal and at spaced apart sides by side seals;

a transport mechanism for moving the preformed chain of bags that are supplied to the transport mechanism from the supply along a path of travel, wherein the transport mechanism comprises a plurality of belts and a belt spreader, wherein the plurality of belts comprise main transport belts and lip belts, wherein the main transport belts include recesses that the lip belts are pressed into to clamp edges of the chain of bags in the transport mechanism belts, wherein the belt spreader is adapted to open a top end of a bag in the chain of bags for depositing an item to be packaged into the open top end;

a support surface positioned to support the chain of bags from below as the chain of bags is moved along the path of travel;

a bag sealing arrangement for sealing the open end of the bag, the bag sealing arrangement being disposed along the path of travel downstream from the belt spreader; and a bag compressing arrangement for compressing said opposing sides of the preformed bag to remove excess air from the preformed bag prior to sealing the open end of the preformed bag, the bag compressing arrangement being disposed along the path of travel above a second portion of the support surface and between the belt spreader and the bag sealing arrangement, the bag compressing arrangement comprising a pair of compressing members configured to contact an exterior surface of said opposing sides of the preformed bag, wherein the compressing members are below a lowermost surface of the main transport belts and lip belts of the transport mechanism and above a region of the bag in which the item rests while the opposing sides of the preformed bag are substantially upright, the compressing members being movable toward one another to compress the preformed bag therebetween.

15. The packaging machine of claim 14, wherein the support surface is inclined between the first portion and the second portion.

16. The packaging machine of claim 14, wherein the first compressing member comprises a moveable ram mechanism and wherein the second compressing member comprises an opposing plate.

17. The packaging machine of claim 14, wherein the transport mechanism comprises at least one belt for supporting a top portion of the chain of bags and adapted to grip lips on the top portion of the chain of bags.

18. The packaging machine of claim 14, wherein the transport mechanism comprises a plurality of belts adapted to open a top portion of a bag in the chain of bags for depositing an item in the bag and a plurality of belts adapted to close a top portion of a bag in the chain of bags after an item has been deposited in the bag.

* * * * *